US009011640B2

(12) United States Patent
Patt et al.

(10) Patent No.: US 9,011,640 B2
(45) Date of Patent: Apr. 21, 2015

(54) METHOD FOR OBTAINING CELLULOSE FROM BIOMASS COMPRISING LIGNOCELLULOSE

(75) Inventors: Rudolf Patt, Reinbek (DE); Andreas Kreipl, Hamburg (DE)

(73) Assignee: Zylum Beteiligungsgesellschaft mbH & Co Patente II KG, Waltersdorf (DE)

( * ) Notice: Subject to any disclaimer, the term of this patent is extended or adjusted under 35 U.S.C. 154(b) by 0 days.

(21) Appl. No.: 13/263,575

(22) PCT Filed: Feb. 25, 2010

(86) PCT No.: PCT/EP2010/001179
§ 371 (c)(1),
(2), (4) Date: Dec. 21, 2011

(87) PCT Pub. No.: WO2010/115488
PCT Pub. Date: Oct. 14, 2010

(65) Prior Publication Data

US 2012/0132379 A1 May 31, 2012

(30) Foreign Application Priority Data

Apr. 9, 2009 (DE) ..... 10 2009 017 051

(51) Int. Cl.
*D21C 11/00* (2006.01)
*D21C 3/02* (2006.01)
(Continued)

(52) U.S. Cl.
CPC .. *D21C 3/02* (2013.01); *D21C 3/20* (2013.01); *D21C 3/222* (2013.01); *D21C 5/00* (2013.01); *D21C 11/0007* (2013.01)

(58) Field of Classification Search
USPC ..... 162/38
See application file for complete search history.

(56) References Cited

U.S. PATENT DOCUMENTS
2,192,202 A * 3/1940 Peterson et al. ..... 162/40
2,218,479 A * 10/1940 Peterson et al. ..... 162/37
(Continued)

FOREIGN PATENT DOCUMENTS
AU 756976 1/2003
CA 2368872 10/2000
(Continued)

OTHER PUBLICATIONS
International Preliminary Report on Patentability (English translation) for International Patent Application No. PCT/EP2010/001179, dated Oct. 14, 2011, 6 pages.
(Continued)

*Primary Examiner* — Jacob Thomas Minskey
(74) *Attorney, Agent, or Firm* — Morgan, Lewis & Bockius LLP

(57) ABSTRACT
The invention relates to a method for obtaining cellulose by separating lignin from a biomass comprising lignocellulose in the form of plants or plant parts, wherein the biomass comprising lignocellulose is solubilized in a boiler in an alkaline medium comprising alkanol amine, and dissolved lignin is separated from the resulting raw cellulose. Said method is characterized in that the biomass comprising lignocellulose is not from a wood source, and is solubilized at a temperature of less than approximately 170° C. in a solubilizing agent based on alkanol amine and water, wherein the weight ratio of alkanol amine to water is set to 80:20 to 20:80, and raw cellulose thus produced is separated from the waste lye using a typical method. Said method is particularly advantageous for obtaining cellulose from annual plants, particularly wheat straw. The method is advantageously improved in that the solubilization takes place in the presence of a catalyst, particularly of anthrachinon. An advantageous bleaching process may be performed subsequently. Said method is characterized by great economic efficiency, particularly due to the high reclamation rates of the alkanol amine used, and leads to lower environmental impact in wastewater, and to reduced disposal costs. The design of the method leads to a greater yield of cellulose and largely prevents degradation of alkanol amine, particularly monoethanol amine (MEA).

23 Claims, 1 Drawing Sheet

(51) Int. Cl.

| | |
|---|---|
| *D21C 3/20* | (2006.01) |
| *D21C 3/22* | (2006.01) |
| *D21C 5/00* | (2006.01) |

(56) References Cited

U.S. PATENT DOCUMENTS

| | | | | |
|---|---|---|---|---|
| 4,178,861 | A | 12/1979 | Vanderhoek et al. | |
| 4,213,821 | A * | 7/1980 | Vanderhoek et al. | 162/72 |
| 4,597,830 | A | 7/1986 | April et al. | |
| 4,790,905 | A * | 12/1988 | Nivelleau de La Bruniere et al. | 162/56 |
| 2001/0047852 | A1 * | 12/2001 | Franks | 162/4 |

FOREIGN PATENT DOCUMENTS

| | | |
|---|---|---|
| CN | 1034595 | 8/1989 |
| CN | 1352716 | 6/2002 |
| DE | 10049340 | 4/2002 |
| WO | 0061858 | 10/2000 |
| WO | 0229155 | 4/2002 |
| WO | 2004061224 | 7/2004 |

OTHER PUBLICATIONS

International Search Report (English translation) for International Patent Application No. PCT/EP2010/001179, dated Jun. 9, 2010, 3 pages.

Office Action issued in Chinese Patent Application No. 201080022863.9, dated Feb. 28, 2013, 7 pages.

English translation of Office Action issued in Chinese Patent Application No. 201080022863.9, dated Feb. 28, 2013, 10 pages.

Examination Report issued in New Zealand Patent Application No. 595745, dated Aug. 22, 2012, 3 pages.

Office Action issued in German Patent Application No. 102009017051.0, dated Apr. 6, 2010, 7 pages.

English translation of Office Action issued in German Patent Application No. 102009017051.0, 4 pages.

Chinese Office Action issued in Chinese Patent Application No. 201080022863.9, dated Feb. 28, 2013, 7 pages.

English translation of Chinese Office Action issued in Chinese Patent Application No. 201080022863.9, dated Feb. 28, 2013, 10 pages.

Russian Office Action issued in Russian Patent Application No. 2011143465/12, dated Jun. 11, 2013, 5 pages.

English translation of Russian Office Action issued in Russian Patent Application No. 2011143465/12, dated Jun. 11, 2013, 4 pages.

Description of Kappa number from Wikipedia at http://en.wikipedia.org/wiki/Kappa_number accessed on Jan. 14, 2014.

Office Action issued in Chinese Patent Application No. 201080022863.9, dated Nov. 18, 2013, 7 pages.

English translation of the Office Action issued in Chinese Patent Application No. 201080022863.9, dated Nov. 18, 2013, 11 pages.

* cited by examiner

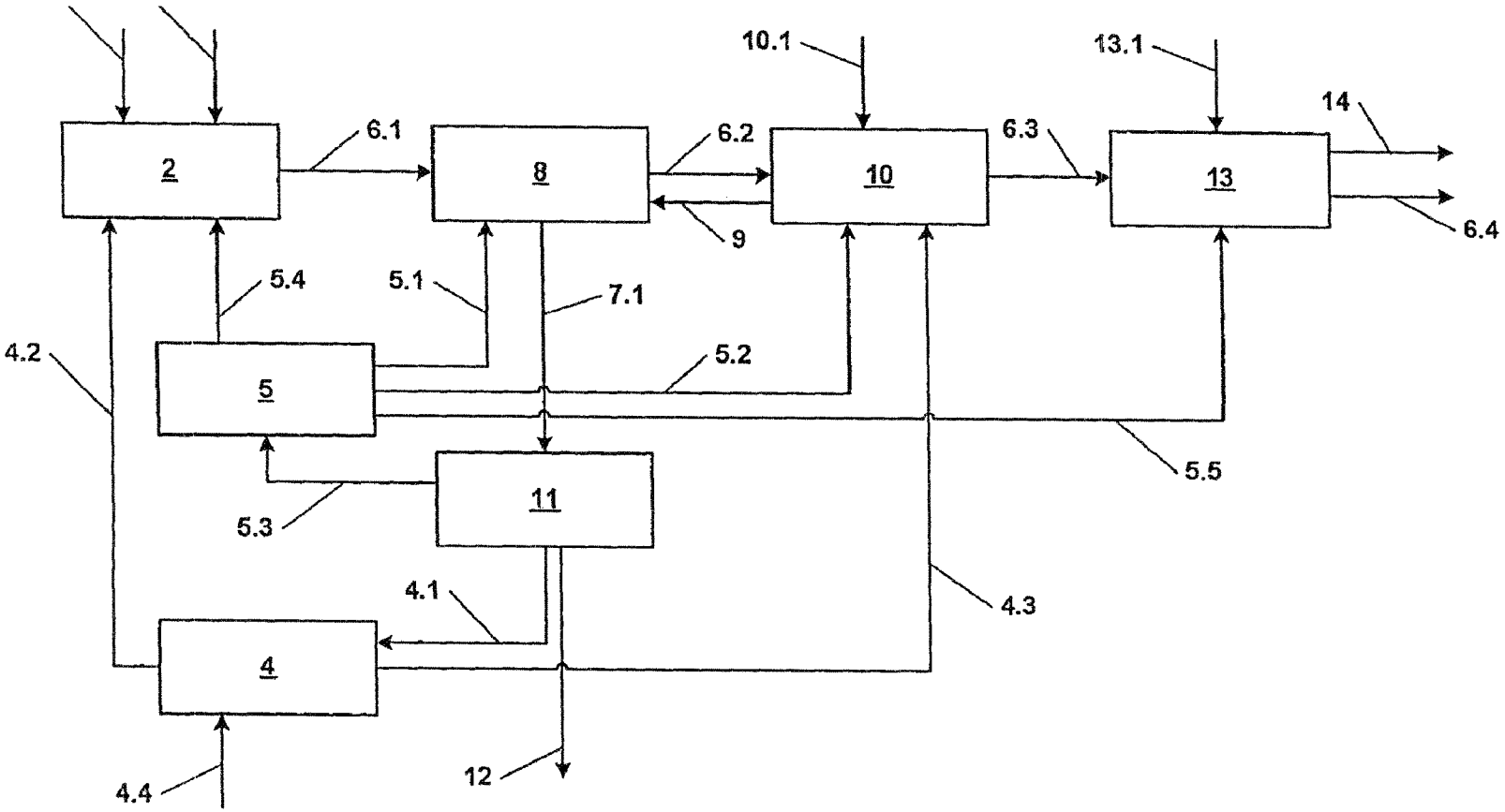
2
4
5
8
10
11
13
4.1
4.2
4.3
4.4
5.1
5.2
5.3
5.4
5.5
6.1
6.2
6.3
6.4
7.1
9
10.1
12
13.1
14

METHOD FOR OBTAINING CELLULOSE FROM BIOMASS COMPRISING LIGNOCELLULOSE

CROSS-REFERENCE TO RELATED APPLICATIONS

This application is a National Stage Application of International Application No. PCT/EP2010/001179, filed on Feb. 25, 2010, which claims priority benefit from DE 102009017051.0 filed Apr. 9, 2009, now expired, each of which are incorporated herein by reference in their entirety.

The invention relates to a method for obtaining pulp by removal of lignin from a lignocellulosic biomass, more particularly from straw and other fiber-yielding nonwood plants, the lignocellulosic biomass being digested in a digester in an alkaline medium comprising alkanolamine, and dissolved lignin and low molecular mass carbohydrates being removed from the resulting raw pulp.

The last thirty years have seen continual rises in the worldwide production of pulp from biomass other than wood. The proportion worldwide of fibrous stocks not originating from wood as starting material is almost 12%. Wheat is cultivated across all continents, and so its straw could be utilized extensively for producing pulp. According to the statistics of the United Nations' FAO (from 2007), worldwide production of wheat is in excess of 600 million metric tonnes. Of this figure, 15 million metric tonnes were produced in Iran alone. Roughly half of the wheat straw produced is used in farms. The other half is either burnt or plowed into the soil. From these data it can be concluded that the amount of wheat straw available for pulp production could be used to produce, on an annual basis, 100 million metric tonnes of pulp. In actual fact, only 4.5 millions of wheat straw pulp are produced. Digestion with sodium hydroxide is a dominant method for producing pulp from annual plants. It has major disadvantages. Strongly alkaline digestion liquors dissolve carbohydrates to a considerable degree, and this is detrimental to the yield of pulp. The majority of annual plants contain a high level of silicates, which are dissolved to a considerable degree in the strongly alkaline digestion solutions, leading to serious problems in the evaporation units and the recovery boilers. These are the main reasons why the handling of waste liquors from the soda process and the recovery of the digestion chemicals continue to be problematic.

In theory, organic solvents, alone or in mixtures with water, can overcome the chemicals recovery problems associated with conventional pulp production from annual plants. In particular, low-boiling alcohols or organic acids can easily be recovered by distillation and returned to a downstream cooking operation. Dissolved organic material can either be burnt for energy recovery or passed on to various applications, such as for alcohol or yeast production or as a raw material for chemicals. Nevertheless, to date, no commercial pulp process is using organic solvents.

For a long time, monoethanolamine (MEA) has been known as a very selective delignifying agent and for the isolation of holocellulose and the determination of its amount in wood (cf. Harlow, W. M., Wise, L. E., Am. J. Botany 25 (1938): pp. 217-219). This was followed by diverse studies into the use of MEA for producing pulp. This research relates primarily to the use of wood as raw material. MEA has been employed in alkaline pulp production in order to support the delignifying process. Extended studies into the use of MEA as sole delignifying agent in the cooking of hardwood (Eucalyptus grandis) and softwood (Pinus elliotti) were conducted by Wallis (cf. Wallis, Cellulose Chemistry and Technology, 10(3) (1976), pp. 345-355). The assumed reactions which take place during the MEA delignification of wood are described in the literature (loc. cit.).

The key feature of pulp production using MEA is the exceptionally good protection afforded to hemicelluloses, resulting in an unusually high pulp yield. On the other hand, the maximum degree of delignification obtained using MEA as sole delignifying agent is limited, especially in the case of softwood. Consequently, stringent cooking conditions, particularly high temperatures, must be employed in order to obtain sufficient delignification when producing a pulp that is suitable for bleaching. In this context it is necessary to bear in mind that MEA undergoes decomposition at a boiling point of around 171°. Consequently, the temperature at biomass digestion ought to be below about 171° C., in order to avoid high losses of MEA. It must also be borne in mind that MEA can be consumed in reactions with lignin and, therefore, that the MEA losses are high if the raw material employed for pulp production contains a high level of lignin, which is difficult to break down on account of its structure.

On the basis of these facts, it can be concluded that MEA ought not to be employed for pulp production from softwood. For pulp production from hardwood, MEA can be used in principle. It appears doubtful that this is a practically useful alternative, since the temperatures to be employed must be high. Even small losses of MEA make this process uncompetitive over conventional kraft pulp processes with their high effective recovery system for inorganic cooking chemicals.

The situation differs entirely when annual plants, such as wheat straw, are used as raw material for the production of pulp by the soda production process. On account of the problem associated with the high level of silicate in alkaline digestion liquors, the majority of plants for producing straw pulp do not have a chemicals recovery system. All of the sodium hydroxide used for the digestion must be replaced. Furthermore, wheat straw has a low lignin content, can be easily digested under mild conditions, and requires a relatively small charge of chemicals to break down lignin. The particularly large advantage of the digestion of annual plants using MEA lies in the direct distillative recovery of MEA. Following the distillation of MEA, the remaining organic material can be employed either as a raw material for chemicals or as nitrogen-containing organic fertilizer, which has a long-lasting effect in contrast to mineral nitrogen fertilizer, since nitrogen is released gradually by microbial degradation of the carrier material.

To complete the relevant prior art outlined above, the following patent literature as well should be addressed: U.S. Pat. No. 4,597,830 is concerned with the digestion of lignocellulose in an aqueous solution comprising a catalyst, such as anthraquinone, where an alcohol/amine mixture is employed in order to promote the digestion of the lignocellulose. U.S. Pat. No. 4,178,861 likewise describes the digestion of lignocellulosic materials, for which it proposes the use inter alia of anhydrous monoethanolamine with simultaneous addition of catalysts, such as anthraquinone. EP-B-0 149 753 is concerned with the digestion of wood under exposure to heat and pressure, by impregnation and cooking of slivers or chips in an aqueous digestion solution which comprises a short-chain alkanolamine, such as monoethanolamine, alongside ammonium hydroxide as catalyst. DE-A-26 40 027 relates to an onward development of the classic soda digestion process, using anthraquinone inter alia.

The above observations from the prior art show that there are diverse objects for improvement here. This is true also of digestion processes which employ alkanolamines, more particularly monoethanolamine. For instance, in the digestion processes described, the loss of consumed alkanolamine is very high, and the attainable delignification is limited. It would be desirable to process cereal straw, which is available in large quantities, more particularly wheat straw, economically, using alkanolamine, into pulp, while avoiding or at least reducing degradation of the pulp and decomposition of alkanolamine during digestion. It would also be desirable largely to recover the alkanolamine from the operation and to pass it back to the process. In developing a desired technical proposal of this kind, it ought additionally to be possible to add an environment-friendly bleaching of the pulp, thereby allowing the overall process of pulp production to be adapted to the technological and economic necessities of a modern pulp production process. The present invention, therefore, is based on the object of fulfilling the requirements set out above.

The achievement of the object addressed herewith, and forming the starting point for the present invention, lies in a development of the above-outlined prior art, to the effect that the lignocellulosic biomass does not originate from wood and is digested at a temperature of less than about 170° C. in a digestion medium based on alkanolamine and water, in which the weight ratio of alkanolamine to water is adjusted to 80:20 to 20:80, and raw pulp produced is separated from the waste liquor by customary methods.

The core of the invention, accordingly, is that not any desired lignocellulosic biomass can be employed for the method identified; instead, the biomass is confined in particular to straw and other fiber-yielding nonwood plants. Moreover, it has emerged, surprisingly, that alkanolamine in a mixture with water, if a particular weight ratio of alkanolamine to water is observed, is particularly suitable as a digestion medium, it being necessary as well to bear in mind the limit on the maximum temperature when implementing the method. The use of the alkanolamine/water digestion medium produces surprising advantages, which will be addressed in detail later on. First of all, a depiction will be given of the features relevant to the invention, and of preferred embodiments of the invention, in more detail.

The method of the invention is directed expressly to the very substantial removal, from the pulp, of lignin and other concomitants, including hemicelluloses (polysaccharides) as well. In this context, the term "lignocellulosic biomass", as shown above, is subject to a relevant restriction in that the lignocellulosic biomass is not to originate from wood, since the desired removal of lignin under advantageous conditions is not possible to a significant extent with wood. For the purposes of the invention, therefore, suitability is possessed in particular by plants and plant parts from annual plants, such as, in particular straw from cereals, such as wheat, barleys, oats, rye, maize, and rice, and also dried grasses, reeds, sugar cane bagasse, and bamboo. Among the annual plants listed above, wheat straw is particularly preferred. These annual plants mostly have a comparatively high silicate content, which is possibly significant for the success obtainable with the invention, but this should not be seen as a restrictive datum. In principle it is possible to employ biomasses which in terms of their chemical and morphological composition are comparable with the materials on which annual plants are based. It should be noted here that the processing of wood to pulp has been solved in the prior art, with the sulfate process being particularly economical.

Generally speaking, the biomass, before being supplied to the method of the invention, is adequately comminuted, as for example by chopping and also, in certain cases, by further comminution. It may also be useful to dry the biomass before the start of the method, although excessive drying is not sensible, since the amount of water introduced into the method of the invention by the biomass, and the amount of water present in the digestion system, must observe the above-addressed boundary conditions for the ratio of alkanolamine to water.

In principle it is possible to use known, prior-art methods to pretreat the biomass before it is supplied to the method of the invention, for the purpose, for example, of achieving preliminary softening of the fiber assembly. This could be done, for instance, by subjecting the starting material to a known steam or ammonia treatment. It has been found, however, that such measures do not in general afford any advantages.

With regard to the term "alkanolamine", the invention is not subject to any relevant restrictions. As alkanolamine it is preferred to employ a short-chain alkanolamine, more particularly an alkanolamine having 1 to 8 carbon atoms, more particularly 1 to 4 carbon atoms. Among these alkanolamines, those considered to be preferred include monoethanolamine, monopropanolamine, monobutanolamine and/or diglycolamine, more particularly monoethanolamine. The monoethanolamine (MEA)/water digestion medium has various advantages. In the digestion, MEA protects the cellulose from degradation and also preserves the hemicelluloses. At the same time it has a delignifying activity. In the digestion of the lignocellulosic biomass and/or in the extraction of the lignin, it may be of advantage additionally to employ a further solvent for lignin, especially one with a swelling effect for the cellulose and hemicellulose.

The boundary conditions to be observed with regard to the ratio of alkanolamine to water are defined as 80:20 to 20:80. It is preferred if the ratio of alkanolamine to water is set at 70:30 to 30:70, more particularly at 60:40 to 40:60. It is especially preferred if the ratio of alkanolamine to water is 53 to 57 to 57 to 53. The amount of water included here relates, as already stated, not only to the water content of the alkanol/water mixture, which constitutes the digestion medium in the digester or autoclave employed, but also to the fraction of water which is introduced into the digestion system by the more or less moist biomass. Thus it would be possible, as a preferred rule, to state that a biomass with too high a water content is to be adjusted judiciously by drying to a water content of about 10% to 30%, more particularly about 15% to 25%. Further dewatering would entail a substantial consumption of energy, and would not afford any advantage.

For the invention it is very important that, when implementing the method for obtaining pulp from the biomass within the digester or autoclave, containing the aforementioned digestion medium of alkanolamine and water, the temperature of about 170° C. is not exceeded. The inventors have found that exceeding this temperature would lead to degradation and loss of the alkanolamine used, more particularly monoethanolamine. On the other hand, higher temperatures could result in unwanted degradation of the pulp. It is particularly advantageous, therefore, to set the temperature at digestion to less than about 165° C., more preferably less than 150° C. Preferred lowest digestion temperatures to be specified are about 120° C., more particularly about 140° C. The temperature range from 140 to 160° C. is considered particularly preferred, since with this range the above-formulated object of the invention is achieved with particular advantage.

When the method of the invention is carried out, the chemicals introduced usually produce an alkaline environment. Accordingly, the pH is above 7, more particularly more than 10 and even about 12. This is evident from the examples below.

In principle it is possible to repeat the method described above in order to obtain further delignification and a purer pulp product. Here it is possible to employ additionally known measures of the prior art.

After the digestion stage carried out in accordance with the invention, the raw cellulose material (cellulose/hemicellulose) is obtained in a conventional way. For instance, the strongly dark brown- to black-colored waste liquor substances can be separated from the raw pulp fibers in a manner familiar to the skilled person, as for example by the methods customary for solid/liquid separation—in particular, for instance, by filtration, by pressing or by centrifuging.

The digestion of the lignocellulosic biomass takes place preferably within a period of 15 minutes to 4 hours, more particularly of 1 to 3 hours, counted from the end of heating. Particularly preferred is a period of 2 to 3 hours. To optimize the method of the invention it is useful to set the liquor ratio of lignocellulosic biomass (dry matter) to be digested to alkanolamine/water digestion mixture advantageously, more particularly at about 8:1 to 2:1, with the range from about 5:1 to 3:1 being particularly preferred.

Lastly, the digestion of the lignocellulosic biomass and/or the extraction of the lignin is accelerated in the presence of suitable catalysts. These are, more particularly, catalytically active quinones, more particularly in the form of naphthoquinone, anthraquinone, anthrone, phenanthrenequinone. Anthraquinone has proven particularly advantageous, but also alkyl-substituted derivatives thereof, such as 2-methylanthraquinone, 2-ethylanthraquinone, 2,6-dimethylanthraquinone, 2,7-dimethylanthraquinone, and the like. Digestion reactions are promoted in the presence of the catalyst, and side reactions strongly suppressed. Moreover, advantageously low kappa numbers are obtained.

The method of the invention can be carried out either continuously or batchwise. In a batch operation, for example, the comminuted lignocellulosic biomass with the water still present therein is admixed, more particularly in an autoclave, with the alkanol/water digestion medium and, optionally and preferably, with one of the catalysts identified. It is necessary here to comply with the mandatory features described for the method of the invention. Continuous digestion is preferably carried out by passing a stream of the optionally preheated digestion medium through the lignocellulosic biomass, introduced into a reactor, or passing the lignocellulosic biomass for extraction and/or digestion in countercurrent to the digestion medium. An advantage which becomes apparent here relative to batch operation, i.e., steady-state operation, is that side reactions are largely ruled out by the removal of the degradation products together with the digestion medium. Furthermore, for a given digestion effect, it is possible to operate with a lower liquor ratio of digestion medium to lignocellulosic biomass, and also at a lower temperature. In another preferred embodiment, the digestion is carried out in multistage operation, i.e., in at least two successive digestions and/or extractions with the respective alkanolamine/water mixture.

The method of the invention can be advantageously embodied by subjecting the lignin-containing liquid phase, obtained following removal of the raw pulp or following removal of the delignified and/or bleached pulp, more particularly by centrifuging, pressing or filtering and washing, and further comprising, in addition to lignin and carbohydrates, biomass extract substances, and optionally the relevant catalyst, to the following treatment: The waste liquor is evaporated in a thin-film evaporator, film evaporator or tube evaporator, with alkanolamine and water being removed. The distillation residue is passed on for further exploitation, for energy generation, as a raw material for chemicals, or else as a nitrogen depot fertilizer, which latter utilization may also be carried out with additions. In order to obtain a pulp of relatively high purity and also low lignin content, it is preferred for the raw pulp, following removal of the waste liquor and optional additional washing, to be bleached. It is useful to configure bleaching in such a way that it is carried out in an alkanolamine/oxygen stage (with alkanolamine as alkali source) for further delignification, after which the bleached pulp is separated from adhering liquid fractions still containing alkanolamine, more particularly by pressing and filtration, in order then to produce a liquid phase, enriched in alkanolamine, which is passed as a filtrate back to the digester, optionally with measures inbetween, such as the washing of the raw pulp. In order to further enrich the liquid phase in alkanolamine, there may be an evaporation with a low thermal load, as already addressed above, which is carried out in particular in a thin-film evaporator, falling-film evaporator, or tube evaporator. With particular preference, the filtrate which is obtained after the measure of bleaching, by pressing off the pulp produced, for example, and which still includes alkanolamine, more particularly MEA, is used as a wash solution for washing the raw pulp separated from the waste liquor from the digester. In principle it could be useful to subject the pulp obtained after bleaching with the alkanolamine/oxygen stage to a further bleaching in customary ECF and TCF sequences, more particularly with exposure to oxygen/and hydrogen peroxide, hydrogen peroxide in the presence of NaOH, $O_3$, $ClO_2$ or formamidinsulfinic acid (FAS).

The procedure according to the invention, described above in abstract, following production of the raw pulp or pure pulp, will be described in more detail below.

Thus it has emerged that the pulp (cellulose/hemicellulose mixture) produced in accordance with the invention or produced after delignification and/or bleaching is not suitable, on account in particular of the adhering alkanolamine, in all desirable subsequent reactions to form valuable products, such as, for example, in particular, for the pyrolytic generation of wood gas for producing fuel. In this case it is appropriate a) to treat the raw pulp, or pulp, with a nonaqueous solvent which dissolves the alkanolamine, for the purpose of removing the alkanolamine which is still adhering, and to separate off the nonaqueous solvent comprising alkanolamine, and/or b) to treat the raw pulp/pulp with a solvent which does not dissolve the alkanolamine, it being possible for the treatment to be carried out either before or after the removal of the solution of the lignin, and the alkanolamine phase being separated off from the two-phase mixture obtained. In the case of measure a), the alkanolamine-containing solvent mixture separated off is separated by distillation, so that the alkanolamine is returned to the operation. It is preferred here to separate off residual alkanolamine by formation of an azeotrope, by adding the nonaqueous solvent that dissolves the alkanolamine toward the end of the distillation. As nonaqueous solvent it is preferred to use ethanol, methanol, DMF, toluene and/or acetone, or an agent which dissolves the alkanolamine. The possibly solvent-moist pulp obtained in accordance with measure a) is preferably reacted directly in a pyrolysis process to form a gas mixture suitable for producing fuel.

In the case of the aforementioned measure b), the procedure is preferably such that the solvent which does not dissolve the alkanolamine is an alkane, more particularly petroleum ether, pentane, hexane, alkane, diesel and/or biodiesel, or a solvent which does not dissolve the alkanolamine. The two-phase mixture obtained in accordance with measure b) is preferably separated (following removal of the raw pulp), and the resulting alkanolamine fraction is preferably then separated by distillation.

As a result of the measures described above, the alkanolamine is largely isolated in the sense of the invention, so it can then judiciously pass back to the start of the method. Moreover, remaining residues of lignin are removed and/or supplied to operations with quantified lignin together with hemicelluloses (polysaccharides). In principle, measures familiar to the skilled person may further be included between the production of the raw pulp and the pulp.

The preferred measures whereby the lignin is separated from the various waste liquors will be illustrated below in more concrete terms: accordingly, water and the alkanolamine employed are separated off by distillation, preferably vacuum distillation. Other separation processes as well that lead as desired to the concentration of the lignin extract (to a dry mass in the extreme case) are suitable. Removal of the lignin is also accomplished by adding a nonsolvent to the solution of the lignin in alkanolamine. In this case, the lignin is precipitated in the form of particulate solids and can be removed from the alkanolamine by means of a suitable solid/liquid separation procedure, such as filtration, centrifugation, thin-film evaporation or membrane. The lignin can be separated off, for example, by introducing carbon dioxide into the optionally concentrated lignin/alkanolamine extract diluted with water or, more preferably, diluted by washing after the alkanolamine extraction. As a result of the concentration by means of thin-film evaporation or another suitable distillation means, a large part of the alkanolamine is removed in pure form and can be returned to the method. The remainder of the alkanolamine is distilled, following distillative removal—likewise under vacuum—of the water from the precipitation fluid after removal of the lignin. The lignin is therefore precipitated by introduction of carbon dioxide and centrifuge removal. The alkanolamine*carbon dioxide addition compound which forms with the carbon dioxide can be decomposed thermally or by nozzle introduction of steam completely back into alkanolamine and carbon dioxide. The residue consists of a degraded, reactive lignin. As a chemical raw material, this reactive lignin can be passed on to diverse areas of application, as for example for the production of thermosets of polyurethanes or binders. Accordingly, the above-described measures a) and b), especially in the case of their advantageous embodiments, produce a lignin-containing, water-rich and/or solvent-rich fraction which can be used more than once, with the lignin being concentrated and a highly lignin-containing and alkanolamine-rich fraction being produced. Only a little water need be removed by distillation from the alkanolamine-rich, low-water-content fraction in order to then make it possible, for example, to recover the major amount of alkanolamine by means of a thin-film evaporation.

The advantages achieved with the present invention are manifest. All of the compounds introduced into the reaction mechanisms either are largely recovered, such as the alkanolamine present in the digestion medium, or, following economical workup, are supplied to beneficial uses. This applies in particular to the lignin and to the carbohydrates dissolved as part of the digestion. The pulp produced in accordance with the invention exhibits a surprisingly high purity and extraordinarily favorable reactivity. It has an advantageous kappa number of less than 20, in some cases of less than 15. The pulp obtained can be employed with advantage for producing paper pulp and chemical pulp, and also for energy production (bioethanol).

In light of the fact that a mixture of alkanolamine and water with a high water fraction is used as digestion medium, the consumption of alkanolamine is greatly reduced. Since digestion with an alkanolamine/water digestion medium in a proportion of about 50:50 proceeds advantageously, particularly with addition of catalyst, it is possible to make considerable savings in terms of alkanolamine, more particularly monoethanolamine, and this leads to a significant increase in profitability. In the case of alkanolamine, the advantage of the recovery lies in a simple vacuum distillation. The invention allows digestion and/or extraction with a favorable liquor ratio (about 8:1 to 2:1), particularly in the case of continuous operation. This has beneficial consequences for the consumption of steam during the digestion, by comparison with conventional digestion processes.

The method of the invention can be integrated with minor modifications into existing plants, with capital costs arising only for an additional distillation unit. In the case of new plants, the costly and inconvenient chemicals recovery is replaced by a simpler and cost-effective distillation. In accordance with the invention, the lignocellulosic biomass can be further-processed to a pulp having particularly advantageous reactivity. This pulp, in a manner known to the skilled person, can be converted, for example, into sugars, which can be fermented to give bioethanol. The alkanolamine obtained after the removal of the lignin has a further value and can be passed back again to the method of the invention. Lastly, the possibility exists of separating the raw pulp (in accordance with the prior art as well) into celluloses and hemicelluloses and in this way obtaining a chemical pulp. With particular preference, the product obtained in accordance with in accordance with the invention, optionally after alkanolamine recovery, more particularly monoethanolamine recovery, is used as a raw material for paper, energy or chemicals or as a nitrogen depot fertilizer.

As already observed, particular advantages are achieved with the monoethanolamine in the context of the invention. As an addition, the following may also be noted: For the monoethanolamine used in each case, more particularly monoethanolamine, there is a very high recovery rate, and this is of great economic importance, particularly in the light of the high costs for monoethanolamine, at about € 1400.00/t. A profitable process becomes possible in the context of the invention using the alkanolamine, as a result of the following: mild conditions, since for the digestion it is possible to select a comparatively low temperature, meaning that MEA is not decomposed (boiling point 170° C.), and reduced use of monoalkanolamine, more particularly MEA, by dilution with water, preferably in a ratio of about 1:1 (NB: on account of the mild conditions of the dilution, the method is preferably confined to annual plants. With wood it would be necessary to select more drastic conditions, leading to the decomposition of MEA).

The invention will now be elucidated in more detail below, with reference to examples, the intention being not least to show which individual parameters are particularly relevant for the invention.

EXAMPLES

In the experiments described below, all of the digestions were carried out using wheat straw from the 2008 harvest from an agricultural operation in Schleswig-Holstein. The straw was comminuted in a chopper, the fine material was separated off and used in this form for the digestions in a 15 l rotary autoclave with external jacket heating and with a process control system. The solids content of the straw was 90.3%. For all of the cooking operations, a uniform 400 g of air-dry straw was used. For all of the digestions, the heating time to a maximum temperature was 60 minutes.

Example 1

In the method as a whole, monoethanolamine (MEA) is the alkanolamine used. From the following overall assessment it emerges that it is a key factor here that the monoethanolamine is used in a mixture with water as digestion medium and is recycled back into the system after the raw pulp, or pulp, has been obtained. The specific procedure is as follows, with reference to the appended flow diagram (FIG. 1):

According to one preferred exemplary embodiment, a plant for carrying out the method of the invention comprises a digester 2, a separating means 8, a delignification unit 10, and a bleaching unit 13. The plant further comprises a distillation means 11, a water container 5, and an MEA container 4. The individual components of the plant are coupled to one another by lines. The arrangement and connection of the individual components to one another are elucidated in more detail in the description of the method below.

The digester 2 has a biomass feed line 1 and a catalyst feed line 3, through which the digester 2 is fed with biomass and catalyst. The biomass preferably comprises wheat straw, as an annual plant. The digester 2 is additionally fed with monoethanolamine (MEA), via a first MEA return line 4.2, and with water, via a digester feed line 5.4. In the digester 2, the biomass is digested in the presence of the catalyst with a digestion solution comprising MEA and water. Digestion takes place preferably at a digester temperature between 130° C. and 170° C., more particularly between 140° C. and 160° C., in particular at about 150° C. The duration of digestion is preferably 130 minutes to 170 minutes, more particularly 140 minutes to 160 minutes, in particular about 150 minutes.

The biomass digestion material is subsequently supplied via a biomass digestion material line 6.1 to the separating means 8. The separating means 8 is additionally supplied, via a first water line 5.1, with water from the water container 5. Within the separating means 8 there is a graduated separation of the pulp from the biomass digestion material. In this procedure, the wash water used is the water passed on via the first water line 5.1. On removal of the pulp, waste liquor is produced, comprising the biomass that has passed into solution and the digestion chemicals supplied to the digester 2, particularly MEA. The waste liquor is passed from the separating means 8 via a waste liquor discharge line 7.1 to the distillation means 11, the functioning of which will be addressed in more detail later on.

The raw pulp separated off in the separating means 8 is supplied via a pulp forwarding line 6.2 to the delignification unit 10. The delignification unit 10 further comprises an oxygen feed line 10.1 and also an MEA feed in the form of a second MEA return line 4.3. Via the second MEA return line 4.3, MEA from the MEA container 4 is passed to the delignifying operation in the delignification unit 10. Furthermore, the delignification unit 10 is connected by a second water line 5.2 to the water container 5, thus allowing the delignifying operation to be supplied with water. In the delignification unit 10, an MEA-$O_2$ bleaching is carried out, with lignin in particular being separated off. The lignin filtrate separated off is passed back via the lignin discharge line 9 to the separating means 8, and used for the washing of the raw pulp that is carried out in the separating means 8.

Following the MEA/$O_2$ bleaching in the delignification unit 10, the bleached pulp is passed via a pulp feed line 6.3 to the bleaching unit 13. The bleaching unit 13 further comprises a bleach supply line 13.1, through which bleach, as for example O/P, $O_3$, P, $ClO_2$ and/or FAS, can be supplied. The bleaching operation in the bleaching unit 13 may comprise elemental chlorine-free (ECF) or totally chlorine-free (TCF) sequences. In the bleaching unit 13, the pulp is lightened to higher whitenesses. Furthermore, the bleaching unit 13 is supplied by a third water line 5.5 with water from the water container 5, and so the pulp is washed in the bleaching unit 13. Here, the bleaching filtrate is removed from the pulp and taken off via a filtrate discharge line 14. The pulp obtained is passed away from the bleaching unit 13 via a pulp discharge line 6.4.

In the distillation means 11, the waste liquor separated off in the separating means 8 and supplied via the waste liquor discharge line 7.1 to the distillation means 11 is separated again. As a result of the separation or distillation in the distillation means 11, water and MEA are recovered. The recovered water, or waste water, is supplied via a waste water line 5.3 to the water container 5, and is available again to the method for obtaining pulp. Similarly, the MEA is recovered, and the MEA is supplied via an MEA feed line 4.1 to the MEA container 4. The MEA container 4 further comprises an MEA inlet 4.4, via which MEA can be supplied or topped up from the outside. This may be useful when there are losses of MEA during the production process. The distillation means 11 further comprises a solids discharge line 12, via which waste liquor substances left over following the removal of water and MEA, more particularly dry waste liquor substances, are taken off.

Example 2

Effect of the Temperature in the MEA Digestion of Wheat Straw

The key requirement for a reduction in MEA decomposition during digestion is the lowering of the cooking temperature. Accordingly, the digestion temperature was varied between 165° C. and 130° C. The conditions employed otherwise, and the results, are listed in table 1. For comparison, soda and soda/anthraquinone (AQ) digestions were carried out, which are the standard process for the digestion of straw on the industrial scale. It was found that the digestion temperature can be lowered down to 150° C. (WS 10; WS 3-5) without any decrease in the delignification performance of the system (kappa number), and the yields are situated at a high level. In comparison to the conventional soda or soda/QA digestions, the yields are higher by up to 12%/raw material, implying approximately a quarter more pulp production from the same quantity of raw material.

In comparison to the soda pulps, the MEA pulps had very low whitenesses (15% ISO as against 28% ISO). Pretreatment of the digestion material with ammonia did not bring any advantages here (WS7-WS9).

TABLE 1

(Digestion of wheat straw in a 15 liter MK digester)

| Experiment number | WS1 | WS2 | WS10 | WS3 | WS4 |
|---|---|---|---|---|---|
| Digestion process | soda | soda/AQ | MEA | MEA | MEA |

TABLE 1-continued (Digestion of wheat straw in a 15 liter MK digester)

| Code | | soda 1 | soda/AQ 1 | MEA5 | MEA1 | MEA2 |
|---|---|---|---|---|---|---|
| Quantity used | g | 400 | 400 | 400 | 400 | 400 |
| Solids | % | 90.3 | 90.3 | 90.3 | 90.3 | 90.3 |
| NaOH | % | 16 | 18 | 0 | 0 | 0 |
| AQ | % | / | 0.1 | / | / | / |
| MEA | % | / | / | 400 | 400 | 400 |
| Ammonia | % | / | / | / | / | / |
| Liquor ratio* | / | 4 | 4 | 4 | 4 | 4 |
| Heating time | min | 60 | 60 | 60 | 60 | 60 |
| Temperature | ° C. | 160 | 160 | 165 | 160 | 155 |
| Cooking time at Tmax | min | 60 | 100 | 90 | 90 | 150 |
| Final pH | / | 12.2 | 12.1 | / | / | / |
| Total yield | % | 46.5 | 48 | 56.6 | 57.1 | 56.4 |
| Product fraction | % | 42.6 | 46.3 | 54.1 | 53.6 | 53.3 |
| Fragments | % | 3.9 | 1.7 | 2.5 | 3.5 | 3.1 |
| Viscosity | g/ml | 877 | 906 | 1020 | 1002 | 991 |
| Whiteness | % ISO | 28 | 28.2 | 14.7 | 16 | 16.4 |
| Kappa number | / | 14.6 | 12.1 | 16.7 | 17.4 | 17.3 |

| Experiment number | | WS5 | WS6 | WS7 | WS8 | WS9 | WS11 |
|---|---|---|---|---|---|---|---|
| Digestion process | | MEA | MEA | A-MEA | A-MEA | A-MEA | MEA |
| Code | | MEA3 | MEA4 | AMEA1 | AMEA2 | AMEA3 | MEA6 |
| Quantity used | g | 400 | 400 | 400 | 400 | 400 | 400 |
| Solids | % | 90.3 | 90.3 | 90.3 | 90.3 | 90.3 | 90.3 |
| NaOH | % | 0 | 0 | 0 | 0 | 0 | 0 |
| AQ | % | / | / | / | / | / | / |
| MEA | % | 400 | 400 | 400 | 400 | 400 | 400 |
| Ammonia | % | / | / | 10 | 10 | 10 | / |
| Liquor ratio* | / | 4 | 4 | 4 | 4 | 4 | 4 |
| Heating time | min | 60 | 60 | 60 | 60 | 60 | 60 |
| Temperature | ° C. | 150 | 150 | 150 | 140 | 130 | 150 |
| Cooking time at Tmax | min | 240 | 150 | 150 | 150 | 240 | 90 |
| Final pH | / | / | / | / | / | / | / |
| Total yield | % | 56.8 | 58.9 | 57.6 | 58.4 | 64 | 57.6 |
| Product fraction | % | 54 | 54.3 | 53 | 55.3 | 52.8 | 56.3 |
| Fragments | % | 2.8 | 4.6 | 4.6 | 3.1*** | 11.2 | 1.3*** |
| Viscosity | g/ml | 991 | 948 | 909 | 863 | 818 | / |
| Whiteness | % ISO | 15.5 | 15.5 | 19 | 16.8 | 15 | / |
| Kappa number | / | 17.1 | 18.7 | 18.7 | 21.8 | 24.8 | / |

Notes:

*MEA digestions = MEA/straw ratio, addition of 250 ml of water for the loss-free entrainment of the MEA, actual liquor ratio: 4.77

**A-MEA: with ammonia pretreatment: 10%/air-dry straw, liquor 3:1, 33-minute heating time to 120° C., 10 minutes at 120° C., followed by offgassing

***Cooked material was additionally beaten with an Ultra-Turrax prior to beating in the pulper (preliminary experiment for MEA quantification), resulting in fewer fragments and a higher product fraction

Example 3

Replacement of a Portion of the MEA in the Digestion by Water

In order to reduce further the specific MEA consumption in the digestion, MEA was gradually replaced by water. The results are compiled in table 2 below. A reduction in the MEA fraction of the digestion solution to 50% had virtually no adverse effect on the digestion. Under conditions which otherwise remain the same, the kappa number increased only by 2.5 units (WS6; WS16, 17). When the MEA content of the digestion solution was lowered to 37.5%, the kappa number increased by one further unit (WS23), whereas with a 25% MEA fraction it jumped by 16 units, in association with a severe increase in the straw fraction not sufficiently digested for defibering, in the form of fragments (WS18). On the basis of these results, MEA-$H_2O$ ratios of 50:50 were operated in the standard cooking operations.

TABLE 2

| Experiment number | WS6 | WS16 | WS17 | WS18 | WS19 | WS20 | WS21 | WS22 | WS23 | WS24 |
|---|---|---|---|---|---|---|---|---|---|---|
| Digestion method | MEA | W-MEA | W-MEA | W-MEA | W-MEA | W-MEA | W-MEA | W-MEA | W-MEA | MEA |
| Code | MEA4 | MEAS1 | MEAS2 | MEAS3 | MEAS4 | MEAS5 | MEAS6 | MEAS7 | MEAS8 | MEAS9 |
| Amount used (gr) | 400 | 400 | 400 | 400 | 400 | 400 | 400 | 400 | 400 | 400 |
| Solids (%) | 90.3 | 90.3 | 90.3 | 90.3 | 90.3 | 90.3 | 90.3 | 90.3 | 90.3 | 90.3 |
| AQ (%) | / | / | / | / | 0.1 | 0.1 | 0.1 | / | / | 0.1 |
| MEA (%) | 100 | 75 | 50 | 25 | 50 | 25 | 37.5 | 50 | 37.5 | 100 |
| Water (%) | / | 25 | 50 | 75 | 50 | 75 | 62.5 | 50 | 62.5 | / |

TABLE 2-continued

| | | | | | | | | | | |
|---|---|---|---|---|---|---|---|---|---|---|
| DMAP (%) | / | / | / | / | / | / | / | 0.1 | / | / |
| Liquor ratio* | 4 | 4 | 4 | 4 | 4 | 4 | 4 | 4 | 4 | 4 |
| Heating time (min) | 60 | 60 | 60 | 60 | 60 | 60 | 60 | 60 | 60 | 60 |
| Temperature | 150 | 150 | 150 | 150 | 150 | 150 | 150 | 150 | 150 | 150 |
| Cooking time at Tmax (min) | 150 | 150 | 150 | 150 | 150 | 150 | 150 | 150 | 150 | 150 |
| Total yield (%) | 58.9 | 57.6 | 59.7 | 62.6 | 57.7 | 61.5 | 56.8 | 56.9 | 58.6 | 53.5 |
| Product fraction (%) | 54.3 | 54.8 | 56 | 52 | 56 | 56.2 | 54.9 | 54.1 | 54.7 | 52 |
| Fragments (%) | 4.6 | 2.8 | 3.7 | 10.6 | 1.7 | 5.35 | 1.9 | 2.8 | 3.9 | 1.5 |
| Viscosity (mg/l) | 948 | | | | | | | | | |
| Whiteness (ISO %) | 15.5 | 12.4 | 14.8 | 10.6 | 15.7 | 10.2 | 15.1 | 14.8 | 14.5 | 15.5 |
| Kappa number | 18.7 | 19.5 | 22.2 | 39 | 15.7 | 29.4 | 19.5 | 18.3 | 23.6 | 14.6 |

| Experiment number | WS25 | WS26 | WS27 | WS28 | WS29 | WS30 | WS31 | WS32 | WS33 | WS34 | | |
|---|---|---|---|---|---|---|---|---|---|---|---|---|
| Digestion method | W-MEA | WOMEA | WOMEA | W-MEA | MEA | W-MEA | W-MEA | W-MEA | W-MEA | W-MEA | | |
| Code | MEAS10 | MEAS11 | MEAS12 | MEAS13 | MEAS14 | MEAS15 | MEAS16 | MEAS17* | MEAS18* | MEAS19* | | |
| Amount used (gr) | 400 | 400 | 400 | 400 | 400 | 400 | 400 | 400 | 400 | 400 | | |
| Solids (%) | 90.3 | 90.3 | 90.3 | 90.3 | 90.3 | 90.3 | 90.3 | 90.3 | 90.3 | 90.3 | | |
| AQ (%) | 0.05 | 0.1 | 0.1 | / | / | / | 0.1 | 0.1 | 0.1 | 0.1 | | |
| MEA (%) | 50 | 37.5 | 37.5 | 37.5 | 100 | 50 | 50 | 50 | 50 | 50 | | |
| Water (%) | 50 | 62.5 | 62.5 | 62.5 | / | 50 | 50 | 50 | 50 | 50 | | |
| DMAP (%) | / | / | / | 0.1 | 0.1 | 0.1 | 0.1 | / | / | / | | |
| Liquor ratio* | 4 | 4 | 4 | 4 | 4 | 4 | 4 | 4 | 4 | 4 | | |
| Heating time (min) | 60 | 60 | 60 | 60 | 60 | 60 | 60 | 60 | 60 | 60 | | |
| Temperature | 150 | 150 | 150 | 150 | 150 | 150 | 150 | 150 | 150 | 150 | | |
| Cooking time at Tmax (min) | 150 | 150 | 150 | 150 | 150 | 150 | 150 | 150 | 150 | 150 | | |
| Total yield (%) | 56.7 | 55.3 | 55.2 | 57 | 52.8 | 56.9 | 57 | 56.9 | 56.4 | 56.7 | 56.6 | Aver- |
| Product fraction (%) | 54.6 | 53.6 | 51.6 | 53 | 50.4 | 53.3 | 55 | 55 | 54.5 | 55 | 54.8 | age |
| Fragments (%) | 2.1 | 1.7 | 3.6 | 4 | 2.4 | 3.6 | 2 | 1.9 | 1.9 | 1.7 | 1.8 | |
| Viscosity (mg/l) | | | | | | | | | | | | |
| Whiteness (ISO %) | 15.3 | 14.8 | 13.3 | 13.3 | 14.2 | 14.5 | 14.4 | | | | 14.4 | |
| Kappa number | 16.6 | 17.8 | 18.5 | 23.8 | 18 | 20 | 17.3 | 17.1 | 17.2 | 17.5 | 17.2 | |

Notes:
W = water
O = oxygen
In MEAS11, oxygen used after cooking and/or in the cooling phase
In MEAS12, oxygen used an hour before the end of cooking
*Cooking operations for bleaching

Example 4

Use of Catalysts in the MEA-$H_2O$ Digestion System

Since the MEA digestion takes place in the alkaline conditions and since AQ is used as a catalyst in known alkaline digestion processes, such as the soda process and the kraft process, in order to accelerate the digestion and to stabilize the carbohydrates against degradation starting from the chain end, this catalyst was also used in the MEA digestion. Quantities of 0.05-0.1%/raw material accelerate digestion considerably. The kappa number is additionally lowered by 4-5 units (WS19-21; WS24, 25). As a result it is possible, with an MEA/$H_2O$ ratio of 37.5:62.5, to achieve the same delignification as in a pure MEA digestion. The use of DMAP (4-dimethylaminophenol hydrochloride) as catalyst in contrast, had no effect on the digestion (WS22; WS28-31).

Example 5

Use of MEA as Alkali Source in the Oxygen Delignification of MEA Pulps

To activate oxygen in the further delignification of pulps, it is customary to use NaOH as alkali source. Investigation was carried out as to whether MEA can replace NaOH as alkali source, since for the completion of the pulp production process it is an advantage if the same base is used as in cooking and in oxygen delignification. In table 3 results of the oxygen delignification using either NaOH or MEA as alkali source are compiled. The amount of NaOH was 2% and 3%, whereas 10-160% of MEA/fibrous material was used. The reaction temperature was varied between 90 and 110° C., while the reaction time was kept constant at 90 minutes.

With an initial kappa number in the unbleached pulp of 19.5, this figure could be lowered to half as a function of temperature and quantity of alkali. In this context, MEA proved to be highly effective, although 20% of MEA/fibrous substance was needed in order to achieve, at 90° C., a kappa number of 10.9, which is suitable for the further bleaching of the pulp (large O stage). The resultant waste bleaching liquor can be separated off in a washer, and used for washing the digester material. It can then be worked up together with the digestion solution (chemicals recovery).

TABLE 3

| | NaOH (%) | MEA used (%) | Temp. | Time (min) | Kappa number | Whiteness (% ISO) | Degree of delignification (%) |
|---|---|---|---|---|---|---|---|
| MEAS6 | / | / | / | / | 19.5 | 15.1 | / |
| MEAS6-O1 | / | 10 | 90 | 90 | 13 | 18.7 | 33.3 |
| MEAS6-O2 | / | 20 | 90 | 90 | 12.3 | 19.8 | 37 |
| MEAS6-O3 | / | 40 | 90 | 90 | 11.5 | 20.1 | 41 |
| MEAS6-O4 | / | 80 | 90 | 90 | 10.8 | 23 | 44.6 |
| MEAS6-O5 | / | 120 | 90 | 90 | 10.8 | 26.05 | 44.6 |
| MEAS6-O6 | / | 160 | 90 | 90 | 9.5 | 26.3 | 51.3 |
| MEAS6-O7 | 2 | / | 90 | 90 | 10.6 | 24.6 | 45.6 |
| MEAS6-O8 | 3 | / | 90 | 90 | 9.5 | 26.9 | 51.3 |
| MEAS6-O9 | / | 10 | 100 | 90 | 12.6 | 22 | 35.4 |
| MEAS6-O10 | / | 20 | 100 | 90 | 11.6 | 24.4 | 40.5 |
| MEAS6-O11 | / | 40 | 100 | 90 | 10.8 | 26.9 | 44.6 |
| MEAS6-O12 | / | 80 | 100 | 90 | 10.6 | 28.6 | 45.6 |
| MEAS6-O13 | / | 120 | 100 | 90 | 10.7 | 28.6 | 45.1 |
| MEAS6-O14 | / | 160 | 100 | 90 | 10.5 | 28.6 | 46.1 |
| MEAS6-O15 | 2 | / | 100 | 90 | 9.7 | 28.2 | 50.2 |
| MEAS6-O16 | 3 | / | 100 | 90 | 9.4 | 31.1 | 51.8 |
| MEAS6-O17 | / | 10 | 110 | 90 | 10.2 | 24.8 | 47.7 |
| MEAS6-O18 | / | 40 | 110 | 90 | 10.2 | 27.2 | 47.7 |
| MEAS6-O19 | / | 160 | 110 | 90 | 10.5 | 25.3 | 46.1 |
| MEAS6-O20 | 3 | / | 110 | 90 | 8.1 | 35.3 | 58.5 |
| MEAS4 | / | / | / | / | 16 | 15.7 | / |
| MEAS4-O21 | / | 20 | 90 | 90 | 9.5 | 24.3 | 40.6 |
| MEAS4-O22 | / | 80 | 90 | 90 | 9.4 | 27.2 | 41.2 |
| MEAS4-O23 | / | 160 | 90 | 90 | 9 | 27.7 | 43.7 |
| MEAS4-O24 | 2 | / | 90 | 90 | 8.7 | 27.3 | 45.6 |
| Cooking for bleaching | / | / | / | / | 17.2 | 14.4 | / |
| Large O stage | / | 20 | 90 | 90 | 10.9 | 21.3 | 36.6 |

Notes:
In all of the O experiments, stock density 20%, O pressure 6 bar, yield after O stage: 97.2%

Example 6

Bleaching of the MEA Pulps

The oxygen-delignified pulp, with a kappa number of 10.9, was bleached in a totally chlorine-free bleaching sequence (TCF) and in a bleaching sequence using small amounts of chlorine dioxide (D). Each bleaching stage was optimized, and the optimized conditions were used in the overall sequence for the bleaching of a relatively large quantity of pulp, in order to determine the papermaking properties of the pulps.

After the oxygen stage, the stock was treated in a complexing agent stage (Q) in order to remove heavy metals. Different complexing agents and complexing-agent combinations were used (see table 4). In order to improve the solubility of the heavy metals, the stock was adjusted with sulfuric acid to pH levels of between 4 and 2.5. After a treatment time of 30 minutes at 60° C., the complexed metals were removed in a washer. The stocks were then bleached in a peroxide-boosted oxygen stage (OP), and alternatively with peroxide alone. The conditions in these stages were varied in order to find optimum conditions (see table 4). The results show that a greater reduction in the pH in the Q stage improves the effectiveness of the subsequent bleaching stage. With regard to the bleaching effect, the OP stage was superior to the P stage, with the peroxide used being taken into account. For this reason, the OP stage was used in the further bleaching sequences.

As already mentioned, both chlorine dioxide (D) and ozone (Z) were used in the final bleaching of the pulps (see table 5). In these stages, complexing agents were added again, in order to make the ozone stage and the concluding peroxide stage (P) more selective.

The chlorine dioxide stage was optimized further with respect to the use of chemicals, and for the bleaching of the large batch an amount of 0.2% of chlorine dioxide/pulp was specified. In the ozone treatment, 0.35% of ozone was used on a constant basis. For both bleaching variants, in conclusion, a peroxide stage was used which was optimized again with respect to the use of chemicals. In the concluding bleaching of the large batches, 2% of $H_2O_2$ and also 2% of NaOH were used in each case.

The final whiteness achieved in the sequence 0-OP-(DQ)-P was 79.8% ISO, whereas in the sequence 0-OP-(ZQ)-P a whiteness of 80.1% ISO was attained (tab. 5). For the majority of areas in which straw pulps are employed, this is a sufficient whiteness.

TABLE 4

| | NaOH (%) | $H_2O_2$ (%) | DTPA (%) | DTPMPA (%) | $MgSO_4$ (%) | $Na_2SiO_3$ (%) | T (° C.) | Time (min) | Kappa number | Whiteness | Residual $H_2O_2$ | Degree of delignification (%) |
|---|---|---|---|---|---|---|---|---|---|---|---|---|
| O | / | / | / | / | / | / | / | / | 10.9 | 21.3 | / | / |
| Q* | / | / | 0.2 | / | / | / | 60 | 30 | 10.9 | 28.1 | / | / |
| OP1 | 2.5 | 4 | / | 0.05 | 0.1 | / | 98 | 90 | 5.8 | 51.6 | 0 | 46.8 |
| OP2 | 2.5 | 4 | / | 0.05 | 0.1 | 2 | 98 | 90 | 4.8 | 62.5 | 0 | 56 |
| OP3 | 2.5 | 4 | / | 0.05 | 0.1 | 2 | 98 | 90 | 4.6 | 63.5 | 0 | 57.8 |

TABLE 4-continued

| | NaOH (%) | $H_2O_2$ (%) | DTPA (%) | DTPMPA (%) | $MgSO_4$ (%) | $Na_2SiO_3$ (%) | T (° C.) | Time (min) | Kappa number | Whiteness | Residual $H_2O_2$ | Degree of delignification (%) |
|---|---|---|---|---|---|---|---|---|---|---|---|---|
| OP4 | 2 | 3 | / | 0.05 | 0.1 | 2 | 98 | 90 | 5 | 61.2 | 0 | 54.1 |
| Q** | / | / | 0.2 | / | / | / | 60 | 30 | 10.9 | 29.8 | / | / |
| QP5 | 2 | 1 | / | / | / | 2 | 98 | 90 | 5.6 | 53.3 | 0 | 48.6 |
| QP6 | 2 | 1.5 | / | / | / | 2 | 98 | 90 | 5 | 59.3 | 0 | 54.1 |
| QP7 | 2 | 2 | / | / | / | 2 | 98 | 90 | 4.7 | 60.4 | 0 | 56.9 |
| QP8 | 2 | 2.5 | / | / | / | 2 | 98 | 90 | 4.7 | 63 | 0 | 59.9 |
| OP-large | 2 | 1.5 | / | / | / | 2 | 98 | 90 | 4.8 | 56 | 0 | 56 |
| Q*** | / | / | 0.2 | / | / | / | 60 | 30 | 4.8 | 57 | / | / |
| P1 | 1.5 | 1 | / | / | / | 2 | 80 | 240 | 3.4 | 50.5 | 0 | 29.2 |
| P2 | 1.75 | 2 | / | / | / | 2 | 80 | 240 | 3.3 | 50.2 | 0 | 31.2 |
| P3 | 2 | 3 | / | / | / | 2 | 80 | 240 | 3.2 | 49.3 | 0 | 33.3 |
| P4 | 2.25 | 4 | / | / | / | 2 | 80 | 240 | 3.2 | 55 | 0 | 33.3 |
| P5 | 1.5 | 1 | / | / | / | 3 | 80 | 120 | 3.3 | 54.1 | 0 | 31.2 |
| P6 | 1.75 | 2 | / | / | / | 3 | 80 | 120 | 3.2 | 55.6 | 0 | 33.3 |
| P7 | 2 | 3 | / | / | / | 3 | 80 | 120 | 3.2 | 57.6 | 0 | 33.3 |
| P8 | 2.25 | 4 | / | / | / | 3 | 80 | 120 | 3.2 | 58.8 | 0 | 33.3 |
| P9 | 1.5 | 1 | / | / | / | 3 | 70 | 120 | 3.3 | 55.6 | 0 | 31.2 |
| P10 | 1.75 | 2 | / | / | / | 3 | 70 | 120 | 3.3 | 56.2 | 0 | 31.2 |
| P11 | 2 | 3 | / | / | / | 3 | 70 | 120 | 3.2 | 55.4 | 0 | 33.3 |
| P12 | 2.25 | 4 | / | / | / | 3 | 70 | 120 | 3.2 | 57.7 | 0 | 33.3 |

Notes:

Q*: pH start 4-pH end 4.5

Q**: pH start 2.8-end 3.2

Q***: pH start 2.5-pH end 3

TABLE 5

| | $ClO_2$ (%) | Ozone (%) | NaOH (*) | $H_2O_2$ (%) | DTPA (%) | DTPMPA (%) | $MgSO_4$ (%) | $Na_2SiO_3$ (%) | T (° C.) | Time (min) | Kappa number | Whiteness | Residual $H_2O_2$ (%) | Degree of delignif. (%) |
|---|---|---|---|---|---|---|---|---|---|---|---|---|---|---|
| OP | / | / | 2 | 1.5 | / | / | / | 2 | 98 | 90 | 4.8 | 56 | / | 56 |
| D(Q)1 | 0.2 | / | / | / | 0.2 | / | / | / | 70 | 120 | 3.2 | 66.5 | / | 33.3 |
| D(Q)2 | 0.4 | / | / | / | 0.2 | / | / | / | 70 | 120 | 3 | 67.2 | / | 37.5 |
| D(Q)3 | 0.6 | / | / | / | 0.2 | / | / | / | 70 | 120 | 2.7 | 68.4 | / | 43.7 |
| D(Q)large | 0.2 | / | / | / | 0.2 | | | | 70 | 120 | 3.3 | 69.8 | / | 31.2 |
| D(Q)P1 | / | / | 1.5 | 2 | / | / | / | 2 | 70 | 30 | 3 | 70.9 | 99.1 | 6.2 |
| D(Q)P2 | / | / | 1.5 | 2 | / | / | / | 2 | 70 | 30 | 2.7 | 71.5 | 99.6 | 10 |
| D(Q)P3 | / | / | 1.5 | 2 | / | / | / | 2 | 70 | 30 | 2.4 | 73.8 | 99.2 | 11.1 |
| Dg(Q)P1 | / | / | 2 | 2 | / | / | / | 3 | 70 | 120 | 2.7 | 78.7 | 98.9 | 18.2 |
| Dg(Q)P2 | / | / | 2.5 | 4 | / | / | / | 3 | 80 | 240 | 2.5 | 80.9 | 40.2 | 24.2 |
| Dg(Q)P3 | / | / | 2 | 2 | / | / | / | 3 | 80 | 240 | 2.7 | 79.7 | 66.6 | 18.2 |
| Dg(Q)P4 | / | / | 2.25 | 3 | / | / | / | 3 | 80 | 240 | 2.6 | 80.1 | 62.8 | 21.2 |
| Dg(Q)P5 | / | / | 2.5 | 4 | / | / | 0.2 | / | 80 | 240 | 2.7 | 80.2 | 41.3 | 18.2 |
| Dg(Q)Plarge | / | / | 2 | 2 | / | / | 0.2 | / | 80 | 240 | 2.7 | 79.8 | 42.2 | 18.2 |
| Z(Q)large | / | 0.35 | / | / | 0.2 | / | / | / | 50 | 9.59 | 1.2 | 78.62 | / | 75 |
| Z(Q)P1 | / | / | 1 | 0.5 | / | / | 0.2 | / | 70 | 120 | 0.9 | 78.7 | 88 | 25 |
| Z(Q)P2 | / | / | 1.2 | 1 | / | / | 0.2 | / | 70 | 120 | 0.8 | 78.9 | 74 | 33.3 |
| Z(Q)P3 | / | / | 2 | 2 | / | / | 0.2 | / | 80 | 120 | 0.8 | 81.4 | 67 | 33.3 |
| Z(Q)Plarge | / | / | 2 | 2 | / | / | 0.2 | / | 80 | 120 | 0.8 | 80.5 | 89.8 | 33.3 |

Example 7

Technological Properties of MEA Pulps

Tables 6 to 8 contain technological and optical values for an unbleached pulp and for the same pulp bleached in the two different sequences. The values found are very good for wheat straw pulps, particularly taking account of the high pulp yields. The strength values in fact increase after bleaching, which is not the case for pulps produced in conventional processes. This may also be attributable to the gentle digestion conditions of the MEA method. Bleaching somewhat reduces the high hemicellulose content of the MEA pulps, with beneficial consequences for the strengths.

Comparisons carried out between wheat straw pulps produced by the MEA method and by the conventional soda/AQ process have shown that MEA pulps are technologically superior to the corresponding soda pulps.

TABLE 6

| Raw material Wheat straw<br>Digestion: MEA | | Chemicals used 200%<br>Kappa number: 17.2/ | | | Yield: 56.6%<br>Whiteness of bleached stock init. 14.4% ISO | | | Product: 54.80%<br>Viscosity: | | |
|---|---|---|---|---|---|---|---|---|---|---|
| WS 32-34; MEAS 17-19 | | 1. Freeness | 2. Freeness | 3. Freeness | 4. Freeness | 5. Freeness | 6. Freeness | Freeness | Freeness | Freeness |
| Freeness | °SR | 33 | 42.5 | 47.5 | 55.5 | | | 40 | 45 | 50 |
| Freeness CSF | ml | 383 | 279 | 235 | 177 | | | 304 | 256 | 216 |
| Beating time | min | 0 | 1 | 2 | 5 | | | 1 | 2 | 3 |
| Specific volume | $cm^3/g$ | 2.2 | 2.22 | 1.89 | 1.8 | | | 2.22 | 2.06 | 1.86 |
| Tear length | km | 6.23 | 6.84 | 7.23 | 7.55 | | | 6.68 | 7.04 | 7.33 |
| Bursting pressure | kPa | 226 | 272 | 288 | 310 | | | 260 | 280 | 295 |
| Bursting pressure 80 $g/m^2$ | kPa | 244 | 299 | 315 | 341 | | | 285 | 307 | 323 |
| Pressure tear strength | cN | 24.9 | 24 | 22.7 | 22.7 | | | 24 | 23 | 23 |
| Pressure tear strength 100 $g/m^2$ | cN | 33.6 | 32.9 | 31.2 | 31.3 | | | 33 | 32 | 31 |
| Fold number | | | | | | | | | | |
| Strength index | | 4.6 | 4.7 | 4.7 | 4.9 | | | 4.7 | 4.7 | 4.8 |
| Tensile index | Nm/g | 61.2 | 67.1 | 70.9 | 74.1 | | | 65.5 | 69 | 71.9 |
| Tear index | mN * $m^2/g$ | 3.4 | 3.3 | 3.1 | 3.1 | | | 3.3 | 3.2 | 3.1 |
| Burst index | kPa * $m^2/g$ | 3.1 | 3.7 | 3.9 | 4.3 | | | 3.6 | 3.8 | 4.0 |
| Absorption index | $m^2/kg$ | 12.06 | 11.01 | 10.23 | 10.39 | | | 11.29 | 10.62 | 10.28 |
| Opacity 80 $g/m^2$ | % | 98.9 | 98.3 | 97.6 | 97.5 | | | 98.5 | 98 | 97.6 |
| LSK | $m^2/kg$ | 24.6 | 21.6 | 19.2 | 18.7 | | | 22.4 | 20.4 | 19.0 |
| Whiteness on RK sheet | % ISO | 24.6 | 23.4 | 22.9 | 22.2 | | | | | |
| Porosity | ml/min | 52 | 33 | 31 | 28 | | | | | |
| Roughness | ml/min | 2336 | 3566 | 3000 | 2829 | | | | | |
| Gurley | sec | 230 | 330 | 356 | 418 | | | | | |

Notes:
Paper: wheat straw MEA32-34 unbleached (15.10.2008)
150° C., 150 minutes, starting material for bleaching studies
Stock designation WS 32-34; MEAS 17-19

TABLE 7

| Raw material Wheat straw<br>Digestion: MEA | | Chemicals used 200%<br>Kappa number: 0.8/ | | | Yield: 56.6%<br>Whiteness of bleached stock init. 14.4% ISO | | | Bleaching OQ(OP)ZP<br>Whiteness, bleached 80.5 | | |
|---|---|---|---|---|---|---|---|---|---|---|
| WS 32-34; MEAS 17-19 | | 1. Freeness | 2. Freeness | 3. Freeness | 4. Freeness | 5. Freeness | 6. Freeness | Freeness | Freeness | Freeness |
| Freeness | °SR | 32 | 42.5 | 46.5 | 53.5 | | | 40 | 45 | 50 |
| Freeness CSF | ml | 396 | 279 | 244 | 190 | | | 304 | 256 | 216 |
| Beating time | min | 0 | 1 | 2 | 5 | | | 1 | 2 | 4 |
| Specific volume | $cm^3/g$ | 2.2 | 1.91 | 1.82 | 1.65 | | | 1.98 | 1.85 | 1.73 |
| Tear length | km | 6.26 | 7.31 | 7.4 | 7.93 | | | 7.06 | 7.37 | 7.66 |
| Bursting pressure | kPa | 290 | 345 | 347 | 351 | | | 332 | 346 | 349 |
| Bursting pressure 80 $g/m^2$ | kPa | 292 | 341 | 350 | 358 | | | 329 | 347 | 354 |
| Pressure tear strength | cN | 28.8 | 28.5 | 26.8 | 24.2 | | | 29 | 27 | 26 |
| Pressure tear strength 100 $g/m^2$ | cN | 36.3 | 35.2 | 33.8 | 30.9 | | | 35 | 34 | 32 |
| Fold number | | | | | | | | | | |
| Strength index | | 4.8 | 5.1 | 5.0 | 5.0 | | | 5.0 | 5.0 | 5.0 |
| Tensile index | Nm/g | 61.5 | 71.7 | 72.6 | 77.8 | | | 69.3 | 72.3 | 75.2 |
| Tear index | mN * $m^2/g$ | 3.6 | 3.5 | 3.4 | 3.1 | | | 3.5 | 3.4 | 3.2 |
| Burst index | kPa * | 3.7 | 4.3 | 4.4 | 4.5 | | | 4.1 | 4.3 | 4.4 |

TABLE 7-continued

| | | | | | | | | | |
|---|---|---|---|---|---|---|---|---|---|
| | $m^2/g$ | | | | | | | | |
| Absorption index | $m^2/kg$ | 0.25 | 0.26 | 0.29 | 0.48 | | 0.26 | 0.28 | 0.38 |
| Opacity 80 $g/m^2$ | % | 74.8 | 71.6 | 69.6 | 69 | | 72.3 | 70.3 | 69.3 |
| LSK | $m^2/kg$ | 24.4 | 20.1 | 18.5 | 15.5 | | 21.1 | 19.1 | 17.0 |
| Whiteness on RK sheet | % ISO | 81.7 | 80 | 78.1 | 71.5 | | | | |
| Porosity | ml/min | 64 | 45 | 37 | 20 | | | | |
| Roughness | ml/min | 1823 | 2416 | 2983 | 3019 | | | | |
| Gurley | sec | 179 | 307 | 382 | 612 | | | | |

Notes:
Wheat straw MEA32-34 OQ(OP)(ZQ)P-1 (15.10.2008)
150° C., 150 minutes, bleached Stock designation WS 32-34; MEAS 17-19

TABLE 8

| Raw material Wheat straw | | Chemicals used 200% | | | Yield: 56.6% | | | Bleaching OQ(OP)DP | | |
|---|---|---|---|---|---|---|---|---|---|---|
| Digestion: MEA | | Kappa number: 2.7/ | | | Whiteness of bleached stock init. 14.4% ISO | | | Whiteness, bleached 79.8 | | |
| WS 32-34; MEAS 17-19 | | 1. Freeness | 2. Freeness | 3. Freeness | 4. Freeness | 5. Freeness | 6. Freeness | Freeness | Freeness | Freeness |
| Freeness | °SR | 34.5 | 45 | 48.5 | 55 | | | 40 | 45 | 50 |
| Freeness CSF | ml | 364 | 256 | 227 | 180 | | | 304 | 256 | 216 |
| Beating time | min | 0 | 1 | 2 | 5 | | | 1 | 1 | 3 |
| Specific volume | $cm^3/g$ | 1.98 | 1.79 | 1.78 | 1.69 | | | 1.88 | 1.79 | 1.76 |
| Tear length | km | 6.41 | 7.27 | 7.48 | 8.02 | | | 6.86 | 7.27 | 7.61 |
| Bursting pressure | kPa | 290 | 339 | 346 | 357 | | | 315 | 339 | 349 |
| Bursting pressure 80 $g/m^2$ | kPa | 300 | 343 | 357 | 369 | | | 323 | 343 | 360 |
| Pressure tear strength | cN | 28 | 28.1 | 26.4 | 24.2 | | | 28 | 28 | 26 |
| Pressure tear strength 100 $g/m^2$ | cN | 36.2 | 35.6 | 34 | 31.2 | | | 36 | 36 | 33 |
| Fold number | | | | | | | | | | |
| Strength index | | 4.8 | 5.1 | 5.0 | 5.0 | | | 5.0 | 5.1 | 5.0 |
| Tensile index | Nm/g | 62.9 | 71.3 | 73.4 | 78.6 | | | 67.3 | 71.3 | 74.6 |
| Tear index | mN * $m^2/g$ | 3.6 | 3.6 | 3.4 | 3.1 | | | 3.6 | 3.6 | 3.3 |
| Burst index | kPa * $m^2/g$ | 3.8 | 4.3 | 4.5 | 4.6 | | | 4 | 4.3 | 4.5 |
| Absorption index | $m^2/kg$ | 0.3 | 0.32 | 0.32 | 0.48 | | | 0.31 | 0.32 | 0.36 |
| Opacity 80 $g/m^2$ | % | 75 | 72.7 | 70.8 | 69 | | | 73.8 | 72.7 | 70.4 |
| LSK | $m^2/kg$ | 23.3 | 20.6 | 18.8 | 15.6 | | | 21.9 | 20.6 | 18.1 |
| Whiteness on RK sheet | % ISO | 78.6 | 76.8 | 76.7 | 71.5 | | | | | |
| Porosity | ml/min | 43 | 25 | 22 | 18 | | | | | |
| Roughness | ml/min | 1095 | 1410 | 1320 | 2461 | | | | | |
| Gurley | sec | 264 | 471 | 574 | 745 | | | | | |

Notes:
Wheat straw MEA32-34 OQ(OP)(DQ)P (10.15.2008) 150° C., 150 minutes, bleached Stock designation WS 32-34; MEAS 17-19

Example 8

Elemental Analysis of the Waste Liquor Substances Dissolved in the Digestion, Following Recovery of the MEA The use of low-boiling organic solvents for pulp production makes it possible to separate the solvent and the components of the digestion material that have gone into solution, by means of distillation. While the solvent is used again, a use needs to be found for the dissolved substances. In conventional processes, this use is energy recovery, in conjunction with the recovery of the inorganic digestion chemicals.

In the case of MEA digestion, consideration may be given not only to the combustion of the concentrated waste liquor solids following distillative removal of the MEA, but also to the use of the dissolved lignocelluloses as a raw material for chemicals or as an organic fertilizer with long-term activity. The latter use requires a very high nitrogen content. In contrast to inorganically bound nitrogen, this nitrogen is delivered slowly to the soil through microbial decomposition of the substrate. Lignocelluloses, furthermore, have a high water absorption and water binding capacity, and increase the pore volume of soils. As is apparent from table 9, about 6% of organically bound nitrogen was detected in MEA-free waste liquors.

TABLE 9

| (Elemental analysis) ThermoQuest EA 1112 | | | | | | | | |
|---|---|---|---|---|---|---|---|---|
| | | Nitrogen (%) | | Carbon (%) | | Hydrogen (%) | | Oxygen (%) |
| Substance | Date of analysis | Meas. value | Average value | Meas. value | Average value | Meas. value | Average value | Average value |
| Wheat straw 016 | Aug. 11, 2008 | 0.46 | 0.45 | 41.83 | 41.88 | 5.66 | 5.61 | 52.05 |
| Wheat straw 017 | Aug. 11, 2008 | 0.44 | | 41.93 | | 5.57 | | |
| MB1 residue 1 p2 034 | Aug. 11, 2008 | 5.98 | 6.02 | 47.16 | 47.45 | 6.39 | 6.44 | 40.08 |
| MB1 residue 1 p2 035 | Aug. 11, 2008 | 6.07 | | 47.75 | | 6.50 | | |
| MB1 residue 2 p2 036 | Aug. 11, 2008 | 6.91 | 6.92 | 45.34 | 45.6 | 6.79 | 6.78 | 40.7 |
| MB1 residue 2 p2 037 | Aug. 11, 2008 | 6.93 | | 45.86 | | 6.77 | | |

*) somewhat inhomogeneous
**) inhomogeneous
***) very inhomogeneous

LIST OF REFERENCE NUMERALS

1 biomass feed line
2 digester
3 catalyst feed line
4 MEA container
4.1 MEA feed line
4.2 first MEA return line
4.3 second MEA return line
4.4 MEA inlet
5 water container
5.1 first water line
5.2 second water line
5.3 waste water line
5.4 digester feed line
5.5 third water line
6.1 biomass digestion line
6.2 pulp forwarding line
6.3 pulp feed line
6.4 pulp discharge line
7.1 waste liquor discharge line
8 separating means
9 lignin discharge line
10 delignification unit
10.1 oxygen feed line
11 distillation means
12 solids discharge line
13 bleaching unit
13.1 bleaching agent supply
14 filtrate discharge line

The invention claimed is:

1. A method for obtaining raw pulp by removal of lignin from a lignocellulosic biomass in the form of plants and/or plant parts, and wherein the lignocellulosic biomass does not originate from wood, comprising the steps of:

digesting the lignocellulosic biomass in a digester at a digestion temperature of less than about 170° C. in a digestion medium to thereby dissolve lignin from said lignocellulosic biomass and generate raw pulp, wherein said digestion medium comprises alkanolamine and water having an alkanolamine to water weight ratio ranging from 60:40 to 30:70;

removing the dissolved lignin from the raw pulp; and separating the raw pulp from a waste digester liquor by solid/liquid separation.

2. The method of claim 1, characterized in that the lignocellulosic biomass comprises annual plants.

3. The method of claim 1, characterized in that lignocellulosic biomass comprises cereal straw.

4. The method of any of claim 1, characterized in that said alkanolamine comprises a short-chain alkanolamine having 1 to 4 carbon atoms.

5. The method of claim 4, characterized in that said alkanolamine is selected from the group consisting of monoethanolamine, monopropanolamine and monobutanolamine and mixtures thereof.

6. The method of claim 1, characterized in that the alkanolamine to water weight ratio ranges from 53:57 to 57:53.

7. The method of claim 1, characterized in that the digestion temperature is set at less than about 165° C.

8. The method of claim 1, characterized in that the digestion temperature is set at 140 to 160° C.

9. The method of claim 1, characterized in that the digesting step is carried out over a period of 15 minutes to 4 hours after reaching the digestion temperature.

10. The method of claim 9, characterized in that the digesting step is carried out over a period of 2 to 3 hours.

11. The method of claim 1, characterized in that a liquor ratio of lignocellulosic biomass to be digested to alkanolamine/water digestion medium ranges from about 8:1 to 2:1.

12. The method of claim 1, characterized in that the digesting step is carried out continuously in the digester.

13. The method of claim 1, characterized in that the digesting step is carried out in the presence of a catalyst.

14. The method of claim 13, characterized in that said catalyst is anthraquinone.

15. The method of claim 1, characterized in that the separating step is performed by a technique selected from the group consisting of: filtration, pressing and centrifuging, to thereby generate a waste liquor filtrate which is enriched in alkanolamine, and optionally after an evaporation step, and returning the waste liquor filtrate to the digester.

16. The method of claim 15, further comprising washing the raw pulp to generate washed liquor; and combining the washed liquor with the waste digester liquor.

17. The method of claim 16 further comprising: separating the raw pulp from the waste digester liquor and optionally washing the separated raw pulp; and bleaching the separated raw pulp.

18. The method of claim 17, characterized in that the bleaching step is carried out as part of an alkanolamine/oxygen stage, with alkanolamine as alkali source, for further lignin removal, and further comprising separating the bleached pulp from adhering liquid fractions which still comprise alkanolamine, so that a liquid phase enriched in alkanolamine, is passed back to the digester.

19. The method of claim 18, characterized in that the separated raw pulp or the bleached raw pulp obtained after bleaching with the alkanolamine/oxygen stage is subjected to further bleaching in customary ECF and TCF sequences.

20. The method of claim 17, characterized in that a filtrate obtained after the bleaching step is used as a wash solution for washing the separated raw pulp.

21. The method of claim 17, characterized in that the bleaching step, is carried out by exposing the separated raw pulp to oxygen/hydrogen peroxide, or hydrogen peroxide each in the presence of NaOH, $O_3$, $ClO_2$ and/or formamidinesulfinic acid (FAS).

22. The method of claim 1, characterized in that an evaporation takes place within a tin film evaporator, falling film evaporator or tube evaporator.

23. The method of claim 1, characterized in that the lignin removal is carried out repeatedly in a digester.

* * * * *